US008377513B2

(12) United States Patent
Saarinen et al.

(10) Patent No.: US 8,377,513 B2
(45) Date of Patent: Feb. 19, 2013

(54) METHOD FOR COATING A COOLING ELEMENT

(75) Inventors: Risto Saarinen, Espoo (FI); Yrjö Leppänen, Tammisaari (FI)

(73) Assignee: Outotec Oyj, Espoo (FI)

( * ) Notice: Subject to any disclaimer, the term of this patent is extended or adjusted under 35 U.S.C. 154(b) by 467 days.

(21) Appl. No.: 12/441,765

(22) PCT Filed: Sep. 7, 2007

(86) PCT No.: PCT/FI2007/000225

§ 371 (c)(1),
(2), (4) Date: Mar. 18, 2009

(87) PCT Pub. No.: WO2008/037836

PCT Pub. Date: Apr. 3, 2008

(65) Prior Publication Data

US 2010/0012501 A1 Jan. 21, 2010

(30) Foreign Application Priority Data

Sep. 27, 2006 (FI) ..... 20060860

(51) Int. Cl.
*B05D 3/00* (2006.01)

(52) U.S. Cl. ..... 427/327; 427/328; 427/457; 266/44; 205/80; 205/118; 205/150

(58) Field of Classification Search ..... 427/327, 427/328

See application file for complete search history.

(56) References Cited

U.S. PATENT DOCUMENTS

| | | | | |
|---|---|---|---|---|
| 2,586,142 | A * | 2/1952 | Bailey et al. | 427/433 |
| 3,329,589 | A * | 7/1967 | Lebrun | 205/76 |
| 3,650,017 | A * | 3/1972 | Gal | 29/527.4 |
| 4,382,585 | A | 5/1983 | Fischer et al. | |
| 4,908,058 | A | 3/1990 | Saarinen | |
| 6,563,855 | B1 | 5/2003 | Nishi et al. | |
| 6,783,726 | B2 | 8/2004 | Polvi | |
| 6,790,481 | B2 * | 9/2004 | Bishop et al. | 427/436 |
| 6,911,176 | B2 * | 6/2005 | Saarinen | 266/193 |
| 2003/0038164 | A1 * | 2/2003 | Saarinen et al. | 228/183 |

FOREIGN PATENT DOCUMENTS

| | | | |
|---|---|---|---|
| DE | 3424480 | A | 1/1985 |
| DE | 3424480 | A1 | 1/1985 |
| JP | 8136156 | A | 5/1996 |
| JP | 10089601 | A | 4/1998 |
| JP | 2001194070 | A | 7/2001 |
| WO | 00/73514 | A1 | 12/2000 |
| WO | 0171267 | A2 | 9/2001 |
| WO | 2004/042105 | A1 | 5/2004 |
| WO | 20040421205 | A1 | 5/2004 |

OTHER PUBLICATIONS

FI International Search Report for FI20060860 issued Mar. 14, 2007, 1 page.

* cited by examiner

*Primary Examiner* — David Turocy

(74) *Attorney, Agent, or Firm* — Chernoff Vilhauer McClung & Stenzel, LLP

(57) ABSTRACT

The invention relates to a method for coating a cooling element (1) mainly made of copper, provided with water cooling pipes (2) and used particularly in connection with metallurgic furnaces or the like, wherein the cooling element includes a fire surface (3) that is in contact with molten metal, suspension or process gas; side surfaces (6) and an outer surface (7), so that at least part of the fire surface (3) is coated by a corrosion resistant coating (5).

15 Claims, 1 Drawing Sheet

METHOD FOR COATING A COOLING ELEMENT

Figure 1:
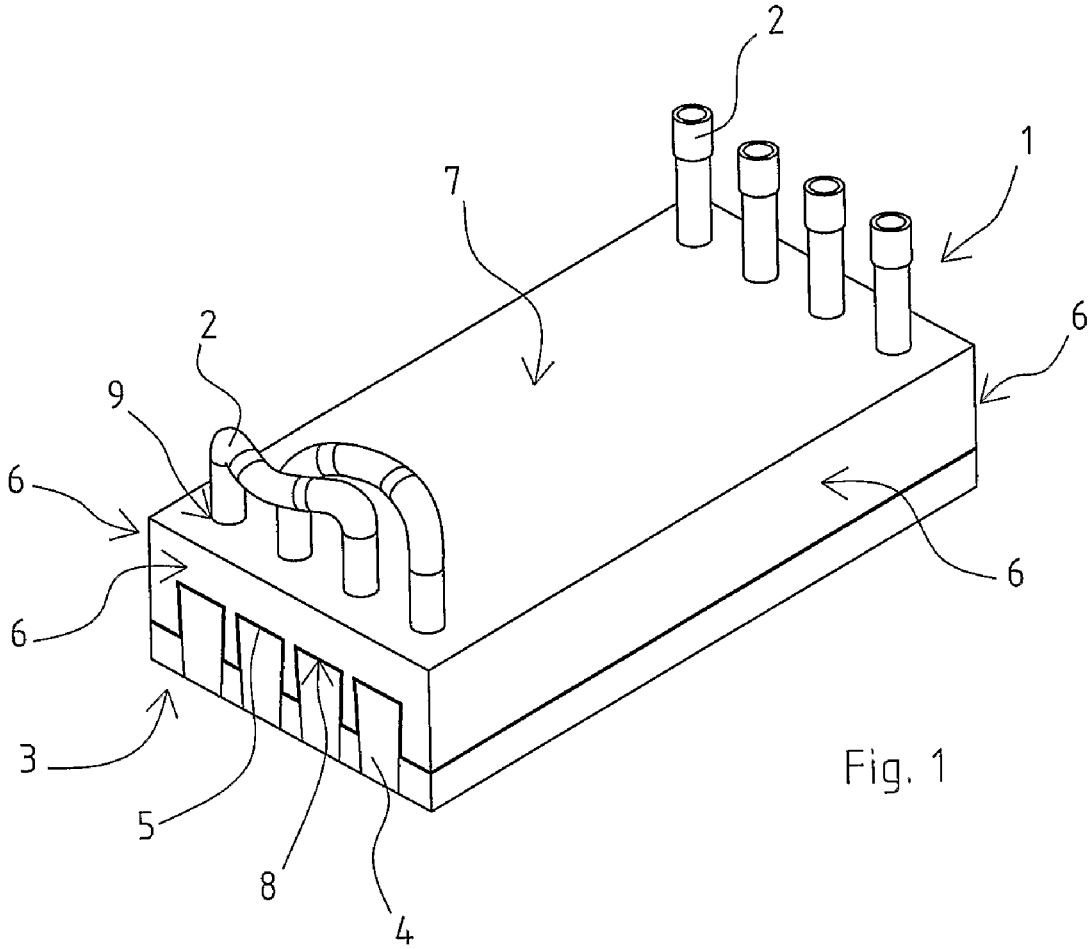

This is a national stage application filed under 35 USC 371 based on International Application No. PCT/FI2007/000225 filed Sep. 7, 2007, and claims priority under 35 USC 119 of Finnish Patent Application No. 20060860 filed Sep. 27, 2006.

The present invention relates to a method for coating a cooling element. According to the invention, at least part of a cooling element fire surface that is in contact with molten metal, suspension gas or process gas is coated by a corrosion-resistant coating.

In connection with industrial furnaces, particularly furnaces used in the manufacturing of metals, such as flash smelting furnaces, blast furnaces and electric furnaces, or other metallurgic reactors, there are used cooling elements that are generally made mainly of copper. The cooling elements are typically water cooled and thus provided with cooling water channels, so that the heat is transferred from the refractory bricks in the furnace space lining through the body of the cooling element to the cooling water. The operation conditions are extreme, in which case the cooling elements are subjected, among others, to strong corrosion and erosion strain caused by the furnace atmosphere or molten contacts. For example the brick lining, constituting the wall lining in the settler of a flash converting furnace, is protected by cooling elements, the purpose of which is to keep the temperature of the masonry so low that the wearing of the bricks in the masonry, due to the above enlisted reasons, is slow. However, in the course of time the masonry becomes thinner, and there may occur a situation where molten metal gets into contact with the cooling element made of copper. In a direct molten contact situation, a copper cooling element does typically not resist the effect of molten metal, particularly if the molten metal is flowing or turbulent, but it begins to melt, and as a consequence the cooling power of the element is overloaded and the element is damaged. This may result in remarkable economical losses, among others.

In furnaces for smelting sulphidic concentrates, the points receiving a large heat load and chemical wear in the cooling element are protected by a brick layer or a metal layer. Often the masonry layer provided in front of the element wears off, thus leaving the fire surface of the cooling element in contact with the process gas, suspension or melt. Owing to the varying conditions, the temperature of the cooling element fire surface, i.e. that surface that is located on the furnace space side, fluctuates within a relatively large area, for instance within the range of 100-350° C. In average, the other surfaces of the element are colder depending on heat load, the water flow speed and the water temperature. In general, part of the cooling element surfaces is at least from time to time in contact with the process gas, the $SO_2/SO_3$ dew point temperature of which is within the same temperature range with the cooling element surfaces, thus causing corrosion damages on said surfaces. It is well known that these damages are poorly resisted by copper. Consequently, the corrosion damages caused in the copper cooling element by the sulfur compounds contained in the gas that are present either around or inside the furnace have become a remarkable problem. Problems occur in cooling elements protected both by brick and metal layers. In particular, problems occur in those spots of the furnace where the cooling element is under strain, either because of an intensive heat load or chemical wear. In elements where cooling water is conducted to cooling water channels drilled inside the cooling element, the junction of the copper cooling pipe and the cooling element is susceptible to corrosion damages. In cooling elements where the copper cooling element is protected by either a metal or a brick layer, the corrosion problem occurs for instance on the boundary surfaces between the protective layer and copper.

The object of the present invention is to achieve a cooling element, whereby the drawbacks of the prior art are avoided. In particular, the object of the invention is to achieve a cooling element that should resist the damaging conditions of the process.

According to the invention, there is provided a method for coating a cooling element, made mainly of copper and provided with cooling water pipes, used particularly in connection with metallurgic furnaces or the like, in which case the cooling element is provided with a fire surface that is in contact with molten metal, suspension or process gas; side surfaces and an outer surface, so that at least part of the fire surface is coated with a corrosion resistant coating.

According to an embodiment of the invention, on part of the fire surface there is formed a protective layer, so that at least part of the cooling element fire surface and the protective layer boundary surfaces are coated with a corrosion resistant coating. By coating the cooling element surfaces against corrosion, there is achieved an element that has longer working life and is more maintenance free. According to a preferred embodiment of the invention, the protective layer is formed at least partly of steel. According to another preferred embodiment of the invention, the protective layer is formed at least partly of ceramic material. By forming a protective layer on the surface of the cooling element, there is achieved a cooling element that is remarkably better resistive to the process conditions in the furnace. By arranging the elements forming the protective layer in the fastening points formed on the cooling element fire surface, such as grooves, there is achieved an extremely functional and effective fastening arrangement.

According to an embodiment of to the invention, the coating is formed of lead, and preferably has a thickness of 0.1-1 millimeters. Lead is well resistant to the corrosion caused by sulfur oxides, because it forms an insoluble sulfate with them. If any surface of the cooling element rises up to a temperature that is higher than the melting point of lead, lead forms with the copper placed underneath a metal alloy that has a higher melting point and hence good resistance against the corrosion of sulfur oxides. The making of a lead coating is a cheap procedure, and consequently the manufacturing and maintenance costs remain low.

According to an embodiment of the invention, the coating is formed on the side surfaces of the cooling element. According to the invention, the coating can also be formed on the outer surface of the cooling element, and on the junction points of the existing cooling water pipes and the outer surface.

In an embodiment of the method, the cooling element is coated by the molten method, in which case melted lead is brought on the surface of the object. The lead layer is formed in different thicknesses, depending on how many times the molten coating is performed. For instance tin can serve as an intermediate layer in order to improve the gripping of lead.

In an embodiment of the method, the coating is formed electrolytically, in which case the coating is formed by immersing the cooling element made of copper in a coating bath as a cathode, and the employed anodes are pure lead plates. According to an embodiment of the method of the invention, the coating is formed prior to applying the protective layer in the cooling element.

According to an embodiment of the invention, the cooling element to be coated is a cooling element of a flash smelting furnace ceiling, wall, uptake shaft or reaction shaft. According to another embodiment, the cooling element to be coated is a cooling element of a flash converting furnace ceiling, wall, uptake shaft or reaction shaft. According to an embodiment, the coated cooling element is the cooling element of an aperture between a flash smelting furnace or flash converting furnace and a waste heat boiler. In the above mentioned locations, the cooling element is, owing to extremely demanding process conditions, subjected to corrosion damages, wherefore a coating according to the invention is useful in them.

Figure 2:
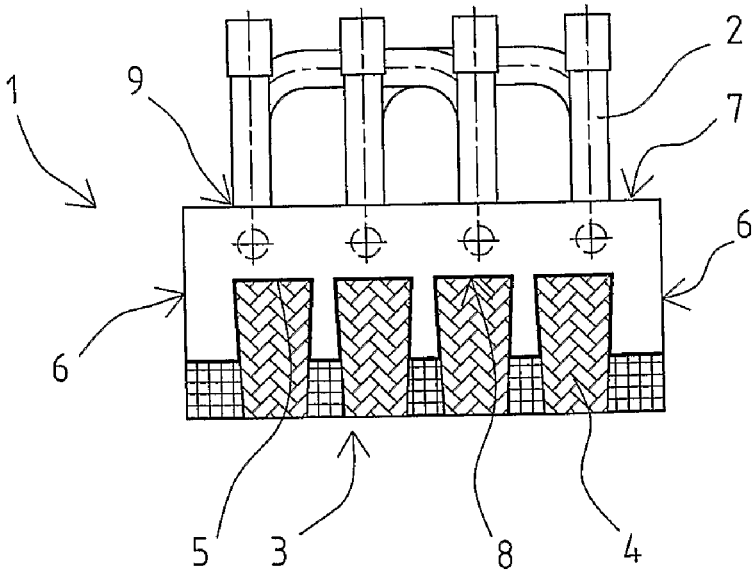

The invention is illustrated in more detail below by an example, with reference to the appended drawings, where FIG. 1 illustrates a cooling element according to the invention, and FIG. 2 shows a section of FIG. 1.

A cooling element 1 according to the invention, made for instance by continuous casting, to be used in connection with metallurgic furnaces or the like, is mainly made of copper, provided with cooling water pipes 2 mainly made of copper, through which pipes the cooling water flows inside the element, for example into cooling water channels made by drilling. A cooling element 1 according to the example is a flash smelting furnace ceiling element, in which case its fire surface 3 is in contact with the flash smelting furnace suspension and/or process gas, and its side surfaces 6 are at least from time to time in contact with the process gas. The outer surface 7 is a side opposite to the fire surface, and the cooling water pipes 2 communicate through the outer surface of the cooling element. On the fire surface 3 of the cooling element, there is embedded a the protective layer 4 formed of refractory elements, such as bricks. The protective layer 4 partly protects the cooling element against damages caused by gas and/or furnace suspension, but often they wear away in the course of time. The temperature of the fire surface 3 of the cooling element is typically 100 - 350° C., the temperature of the other surfaces as well as of the cooling water pipes 2 made of copper is 30 - 350° C., at which temperatures said surfaces are susceptible to corrosion damages caused by sulfur compounds formed in the furnace, because generally they are located within the dew point range of the sulfur trioxide contained by the process gas. Against said corrosion damages, the boundary surfaces 8 of the fire surface 3 and protective layer 4 of the cooling element 1 are coated with a corrosion resistant coating 5, which is preferably lead.

According to the example, the coating is formed electrolytically. The coating 5 is formed by immersing the cooling element 1 made of copper in a coating bath as a cathode, so that the employed anodes are pure lead plates. The coating electrolyte is for example a fluoborate bath. By applying the electrolytical method, a coating is accumulated on all surfaces of the cooling element, and consequently the desired surfaces 3, 6 and 7 are protected against the corrosion caused by the sulfur compounds contained in the process gas. In addition, the junction points 9 of the water cooling pipes and the outer surface 7 of the cooling element are protected by a lead layer. At raised temperatures, lead is diffused into copper, thus forming various Cu—Pb alloys, which also are extremely corrosion resistant, and thus result in a good grip through a metallic bond. The shape and size of the cooling element depend on the target of usage in question.

The invention is not restricted to the above described embodiments only, but many modifications are possible within the range of the inventive idea defined in the appended claims.

The invention claimed is:

1. A method of treating a cooling element for use in a metallurgic furnace, the cooling element being mainly made of copper and being formed with cooling channels for connection to water cooling pipes, wherein the cooling element has a fire surface that, in use, is exposed to a hot medium and also has side surfaces and an outer surface, and at least part of the fire surface is provided with a protective layer, the method comprising electrolytically depositing a corrosion resistant coating of lead over at least part of the boundary surface between the fire surface and the protective layer of the cooling element.

2. A method according to claim 1, wherein the protective layer comprises steel.

3. A method according to claim 1, wherein the protective layer comprises ceramic material.

4. A method according to claim 1, wherein the corrosion resistant coating of lead has a thickness from about 0.1 mm to about 1 mm.

5. A method according to claim 1, comprising providing the corrosion resistant coating on the side surfaces of the cooling element.

6. A method according to claim 1, comprising providing the corrosion resistant coating on the outer surface of the cooling element.

7. A method according to claim 1, comprising providing the corrosion resistant coating by applying molten material to the fire surface of the cooling element.

8. A method according to claim 1, comprising providing the corrosion resistant coating prior to adding the protective layer to the cooling element.

9. A method according to claim 1, wherein the cooling element is a cooling element of a flash smelting furnace ceiling, wall, uptake shaft or reaction shaft.

10. A method according to claim 1, wherein the cooling element is a cooling element of a flash converting furnace ceiling, wall, uptake shaft or reaction shaft.

11. A method according to claim 1, wherein the coated cooling element is a cooling element of an aperture between a flash smelting furnace or a flash converting furnace and a waste heat boiler.

12. A method according to claim 1, wherein the step of providing a corrosion resistant coating over at least part of said boundary surface comprises providing an intermediate layer over said at least part of said boundary surface and providing said corrosion resistant coating of lead over said intermediate layer.

13. A method according to claim 1, wherein the step of electrolytically depositing a corrosion resistant coating of lead comprises electrolytically depositing the corrosion resistant coating of lead on the fire surface, the side surfaces and the outer surface of the cooling element.

14. A method of treating a cooling element for use in a metallurgic furnace or the like, the cooling element being mainly made of copper and being formed with cooling channels connected to water cooling pipes, wherein the cooling element has a fire surface that, in use, is exposed to a hot medium and also has side surfaces and an outer surface, the water cooling pipes are connected to the cooling element at the outer surface of the cooling element, and at least part of the fire surface is provided with a protective layer, the method comprising providing a corrosion resistant coating of lead over of the cooling element, the side surfaces of the cooling element and the outer surface of the cooling element, and on junction points at which the cooling water pipes meet the outer surface of the cooling element, and wherein the step of providing the corrosion resistant coating of lead comprises depositing lead electrolytically on the surfaces of the cooling element.

15. A method of treating a cooling element for use in a metallurgic furnace or the like, the cooling element being mainly made of copper and being formed with cooling channels for connection to water cooling pipes, wherein the cooling element has a fire surface that, in use, is exposed to a hot medium and also has side surfaces and an outer surface, the method comprising providing a corrosion resistant coating of lead over the fire surface of the cooling element, the side surfaces of the cooling element and the outer surface of the cooling element, and subsequently providing at least part of the fire surface with a protective layer, whereby the corrosion resistant coating is provided over at least part of a boundary surface between fire surface of the cooling element and the protective layer, and wherein the step of providing the corrosion resistant coating of lead comprises depositing lead electrolytically on the surfaces of the cooling element.

* * * * *